United States Patent [19]

Scott et al.

[11] Patent Number: 4,886,463

[45] Date of Patent: Dec. 12, 1989

[54] ELECTROMAGNETIC INTERFERENCE CONNECTOR

[75] Inventors: William T. Scott, Ellicott City; Robert A. Leishear, Woodlawn, both of Md.

[73] Assignee: Westinghouse Electric Corp., Pittsburgh, Pa.

[21] Appl. No.: 247,223

[22] Filed: Sep. 21, 1988

[51] Int. Cl.[4] ..... H01R 4/58

[52] U.S. Cl. ..... 439/89; 439/272

[58] Field of Search ..... 439/607, 609, 86, 88, 439/89, 271, 272, 273, 274, 275, 276, 608, 610, 283

[56] References Cited

U.S. PATENT DOCUMENTS 2,379,942 7/1945 Webber ..... 439/89

3,243,756 3/1966 Ruete et al. ..... 439/89

3,617,607 11/1971 Williams ..... 174/35 C 3,744,128 7/1973 Fisher et al. ..... 439/610 X 4,519,664 5/1985 Tillotson ..... 439/607

*Primary Examiner*—Neil Abrams

*Assistant Examiner*—Kheim Nguyen

*Attorney, Agent, or Firm*—G. S. Grunebach

[57] ABSTRACT

A multi-shell mated connector operable to provide electromagnetic interference (EMI), shielding protection for electrical circuits. This improved connector having at least one EMI seal may also incorporate a separate and additional EMI seal to function as an environmental seal to protect the connector pins from the outside environment. The preferred embodiment of this device is most suited for use in D style connectors which previously lacked effective EMI shielding between distinct, but mated connectors.

9 Claims, 2 Drawing Sheets

ELECTROMAGNETIC INTERFERENCE CONNECTOR

BACKGROUND OF THE INVENTION

1. Field of the Invention:

The present invention relates to an improved connecting means operable to shield cables and circuits from electromagnetic interference (EMI) in multi-shell connectors having electrical connector pins.

This device molds or bonds a highly electrically conductive rubber seal to at least one-half of the male or female portion of the multi-shell connector thereby closing any and all air gaps between the mated individual shells of the connectors. During connector engagement this conductive rubber seal provides a low surface impedance between the mated connector shells and an electromagnetic interference (EMI) shield is formed with no openings to the connector pins.

Another embodiment of invention incorporates an additional seal to the multi-shell connectors serving as an environmental shield providing physical protection for the eletrical connection pins from the outside environment during connector operation in adverse environments.

2. Description of the Prior Art:

The miniaturization of electronic equipment has created the need for connectors to electrically support that electronic equipment with a stable electrical signal input. To date, in the area of radio frequency and electromagnetic interference reduction, emphasis has been placed on protecting the miniaturized circuits from mutual radio frequency interference and electromagnetic interference (EMI).

It is well known in the prior art specifically applicable to the shielding of electrical devices and circuits; to shield individual circuits within electronic modules and complete electronic modules in and of themselves. Also, the interconnecting circuits for these modules have been protected by various shielding techniques which provide for low resistance, high permeability strength and flexibility.

The U.S. Pat. No. 4,519,664, issued May 28, 1985 to J. D. Tillotson, entitled, "Multipin Connector and Method of Reducing EMI by Use Thereof", discloses a multi-pin connector operable in the 5–30 MHz range. The individual pins of the Tillotson connector are electrically isolated one from the other by a material having a high magnetic permeability, and a low magnetic retention. And, a second electronically conductive material surrounds the pins. Use of the Tillotson connector results in radiated EMI from the electrical harness dissipated in the form of heat energy within the material surrounding each pin.

The U.S. Pat. No. 3,617,607, issued Nov. 2, 1971 to J. D. Williams, entitled, "Electromagnetic Interference Shield Isolator", discloses a coupler ring operable to isolate and shield cables utilizing an insulating shell for the cable connector housing.

Finally, the U.S. Pat. No. 2,379,942, issued July 10, 1945 to C. A. Webber, entitled, "Cable Terminating Means", describes a cable terminating apparatus for electrical connectors connecting flexible high potential cables. The Webber connector prevents the breakdown of the insulation in connecting cables as a result of a corona discharge through entrapped air pockets, thereby forming ozone. The "shield" in the Webber connector U.S. Pat. No. 2,379,942 comprises a stranded conductor surrounded by; first a thin layer of conducting material, second a thick layer of insulating rubber, and thirdly a thin layer of conducting rubber.

While the various connectors as taught by the prior art addresses various types of EMI shielding needs; none of the prior art patents described above disclose an EMI shield for miniature "D" style connectors. Specifically, no art was found disclosing a seal or ring operable to fill the air gap between mated connectors thereby minimizing EMI leakage of electrical signals as between multi-shell connectors.

The EMI seal described as the preferred embodiment of this application is a highly conductive rubber seal operable to provide low surface impedance between the multi-shells of the connector without external contact of the connecting pins.

The "missing link" in the prior art EMI shielding "chain" is the lack of shielding for the interconnection of cables between miniature electronic devices. Specifically, the problem to be solved is the effective EMI shielding of cables using D style connectors.

SUMMARY OF THE INVENTION

The preferred embodiment of the present invention is an improved, self-sealing, multi-shell, electrical cable interconnecting apparatus which eliminates any air gaps between the interconnected shells thereby eliminating EMI leakage into the electrical circuit through and between these mated shells.

Specifically, at least one highly conductive EMI gasket, or seal, comprising a rubber based material filled with silver plated copper conducting beads fills in the air space which previously existed between the mated multi shell shell connectors.

This EMI seal is a connector improvement which can be easily added or adapted to existing mated shell designs, and has particular application to shielding cables in D style connectors for multi-shell designs.

One embodiment of this device further provides an additional EMI seal which serves as an environmental seal for the connector pins of the multi-shell connector. This secondary EMI environmental seal provides additional shielding against the elements to the silver filler of the EMI gasket and for the pins of the male shell of the connector.

BRIEF DESCRIPTION OF THE DRAWINGS

For a better understanding of the invention reference may be had to the preferred embodiment exemplary of the invention, shown in the accompanying drawings, in which.

DESCRIPTION OF THE PREFERRED EMBODIMENTS

Figure 1A:
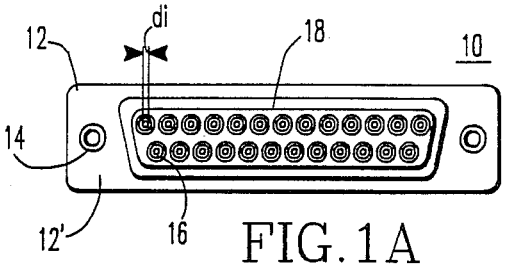
FIG. 1A (PRIOR ART)
FIG. 1A is a top plan view of the mating face of the female portion of the prior art unshielded connector.
Figure 2A:
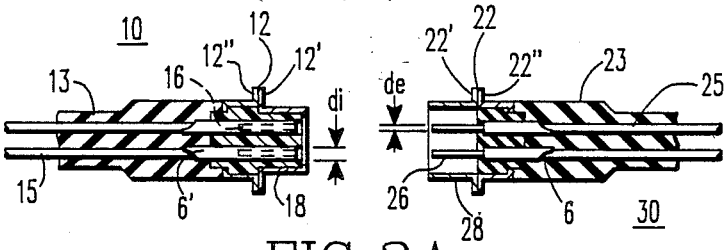
FIG. 2A (PRIOR ART)
FIG. 2A is a side plan view of both the male and the female portions of the prior art unshielded connector before the male and the female portions are interconnected.

FIG. 1A is a top plan view of the mating face of the female portion 10 of the prior art unshielded connector 30, which is shown in greater detail in FIG. 2A. The female portion 10, comprises a connector back plate 12. This connector back plate 12, has a front surface 12', wherein the female portion 10 has mounted upon this front surface 12' two receptacle means 14 which are hollow internally threaded tube means each tube means operable to receive an externally threaded fastening means. A thin walled trapezoidal open socket means 18 is mounted upon the front surface 12' of the connector back plate 12, and extends outward equidistant between the two receptacle means 14. This trapezoidal open socket means 18, besides being trapezoidal in geometric configuration, defines a trapezoidal cavity which fully surrounds a multiplicity of individual, tubular, pin holders 16. These individual, tubular, pin holders 16 have a predetermined internal diameter $d_i$, such that they are operable to receive and hold pins 26, when these pins 26 have a slightly smaller external diameter $d_e$, than the internal diameter $d_i$, of the pin holders 16. These pins 26 may be more clearly seen in FIG. 2A.

Figure 1B:
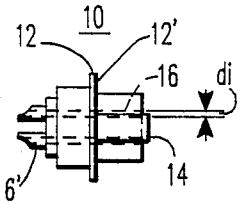
FIG. 1B (PRIOR ART)
FIG. 1B is a side view of the female portion of the prior art unshielded connector.

FIG. 1B is a side view of the female portion 10 of the prior art unshielded connector 30, which is shown in greater detail in FIG. 2A. Female portion 10, has mounted upon connector back plate 12, front surface 12', two receptacle means 14. Connecting pins 6' are physically connected to individual tubular pin holders 16. Trapezoidal open socket means 18 forms a trapezoidal cavity which surrounds pin holders 16. Said pin holders 16 having an interior diameter $d_i$.

Figure 1C:
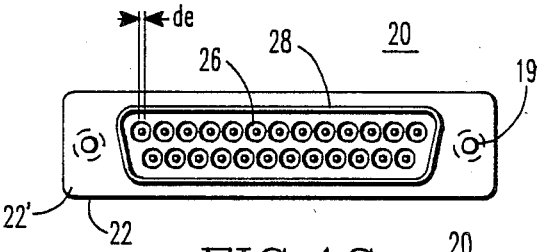
FIG. 1C (PRIOR ART)
FIG. 1C is a top plan view of the mating face of the male portion of the prior art unshielded connector.

FIG. 1C is a top plan view of the male portion 20 of the prior art unshielded connector 30, which is shown in greater detail also in FIG. 2A. The connector back plate 22 for the male portion 20 has a front surface 22' and has cut within it two holes 19. Two threaded fastening means 24, which are shown in greater detail in FIG. 2A are operable to fixedly interconnect within the receptacle means 14 of the female portion 10 as shown in FIG. 2A. A socket means 28, trapezoidal in geometric configuration forms a trapezoidal cavity which is slightly larger than the socket means 18 trapezoidal cavity of the female portion 10 of the unshielded connector 30 as described in FIG. 1A, is mounted upon the front surface 22' of the back plate 22.

As also shown in FIG. 1C, the trapezoidal cavity formed by this socket means 28 is slightly larger than the interior diameter of the trapezoidal cavity formed by socket means 18; socket means 28 is therefore operable to slideably interfit over the trapezoidal socket means 18 of the female portion 10 of the unshielded connector 30 during connector 30 operation. Further, trapezoidal socket means 28, fully surrounds a multiplicity of individual pins 26 which are also mounted upon the front surface 22', of the connector back plate 22 for the male portion 20. These pins 26, have an external diameter $d_e$, such that they are operable to slidably interfit within the pin holders 16 mounted upon the front surface 12', of the connector back plate 12 of the female portion 10 as shown in FIG. 1A, wherein these pin holders 16 have an internal diameter $d_i$, slightly greater than the external diameter, $d_e$, of the pins 26.

Figure 1D:
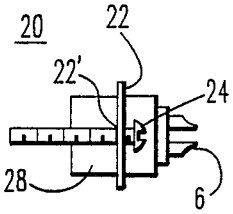
FIG. 1D (PRIOR ART)
FIG. 1D is a side view of the male portion of the prior art unshielded connector.

FIG. 1D is a side view of the male portion 20 of the prior art unshielded connector 30, which is shown in greater detail in FIG. 2A. Male portion 20, has mounted upon connector back plate 22, front surface 22' and two holes 19. Connecting pins 6 are physically interconnected to pins 26 in a one to one relationship. Trapezoidal open socket means 28 forms a trapezoidal cavity means fully surrounding pins 26.

FIG. 2A, is a side plan view of both the male 20 and the female 10 portions of the prior art unshielded connector 30 prior to the interconnection of the male 20 and the female 10 portions of the unshielded connector 30. The female portion 10 in side view comprises a rectangular back plate 12, having mounted upon its front surface 12'; a multiplicity of pin holders 16, each of these pin holders 16 having a predetermined interior diameter $d_i$, and a socket means 18 having a trapezoidal geometric configuration, and a predetermined interior diameter wherein this trapezoidal socket means 18 fully surrounds the pin holders 16. A shielded, braided, cable 15, in this embodiment is shown encapsulated by a molded EMI backshell 13, and is fixedly interconnected by mechanical interconnection to the pin connectors 6' to the back surface 12'' of the connector back plate 12.

The male portion 20 in side view as shown in FIG. 2A comprises a rectangular back plate 22, having mounted upon its front surface 22'; a multiplicity of pins 26, each of these pins 26 having a predetermined exterior diameter $d_e$, and a socket means 28 having a trapezoidal geometric configuration forming a trapezoidal cavity, and a predetermined interior diameter wherein this trapezoidal socket means 28 fully surrounds the pins 26. This socket means 28 resting upon the front surface 22', of the male portion 20 of the connector 30, is further operable to slidably interfit over the socket means 18 of the female portion 10 for the prior art unshielded, connector 30. A shielded cable means 25, encapsulated by a molded EMI back shell 23, as shown in this embodiment is fixedly interconnected to the bottom surface 22'' of the connector back plate 22. This shielded cable 25 interconnects fiber by fiber to the connector pins 6 and with the multiplicity of pins 26 mounted upon the top surface 22' of the male portion 20.

Figure 2B:
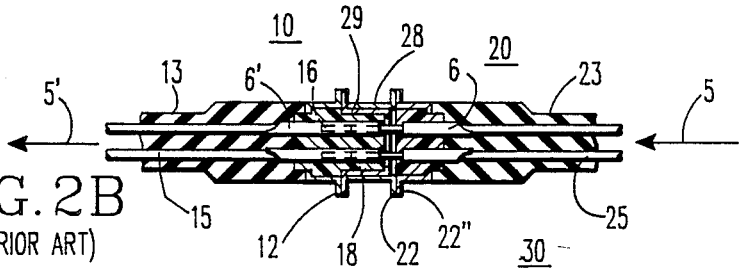
FIG. 2B (PRIOR ART)
FIG. 2B is a side plan view of both the male and the female portions of the prior art unshielded connector after the male and the female portions are interconnected.

The transmission of an input electrical signal 5, and an output through the electrical signal 5' non-EMI shielded, mated, multi-shell, connector 30, can be easily understood from FIGS. 2A and 2B. The male portion 20 and the female portion 10 are fixedly interconnected when the male portion 20 and the female portion 10 are fixedly interconnected in this manner the socket means 18 of the female portion 10 slideably interfits within the socket means 28 of the male portion 20 because the interior trapezoidal cavity of the female portion socket 18 is slightly smaller than the interior trapezoidal cavity of the male portion socket 28. Electrical signal 5 enters the mated, unshielded connector 30 via the braided shielded cable 25. This EMI shielded cable 25, enclosed by backshield 23, which is mechanically attached to the connector pins 6 upon the back surface 22'' of connector plate 22, is operable to transmit electrical signal 5 to the multiplicity of pins 26 (as shown in detail in FIG. 2A) which fixedly interfit over the pin sockets 16 of the female portion 10. The signal 5 then contacts the connector pins 6' of the female portion 10 which are mechanically connected to the back surface 12'' of the connector plate 12. Electrical signal 5' exits into braided cable 15 as EMI shielded by (in this embodiment) molded back shield 13.

FIG. 2B is a side plan view of both the male portion 20 and the female portion 10 of the unshielded connector 30, fixedly interconnected. In this plan view from one side of this connector 30, which comprises a male shell portion 20 and a female shell portion 10, an air gap 29 can be clearly seen between the socket means 18 of the female portion 10 and the socket means 28 of the male portion 20. This air gap 29 which exists between the male portion 20 and the female portion 10 of the mated connector 30, is of sufficient size to facilitate the electromagnetic interference leakage (EMI) into the surrounding electrical circuits and the leakage of stray EMI into the unshielded cable. This EMI leakage degrades the transmission of electrical signals through the prior art connector as well as disrupts electrical circuits within close proximity of the cable connector, 30.

Figure 3A:
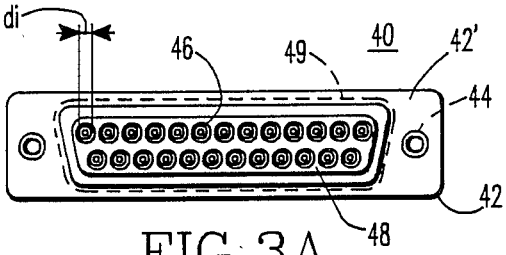
FIG. 3A is a top plan view of the mating face of the female portion of the preferred embodiment, an EMI shielded multi-shell connector.
Figure 3C:
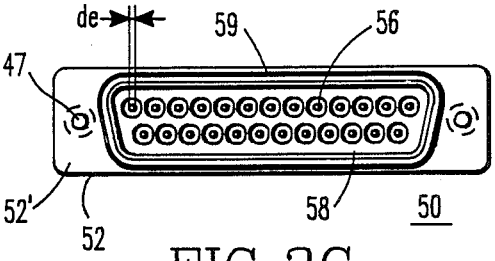
FIG. 3C is a top plan view of the mating face of the male portion of the preferred embodiment, an EMI shielded multi-shell connector.
Figure 4A:
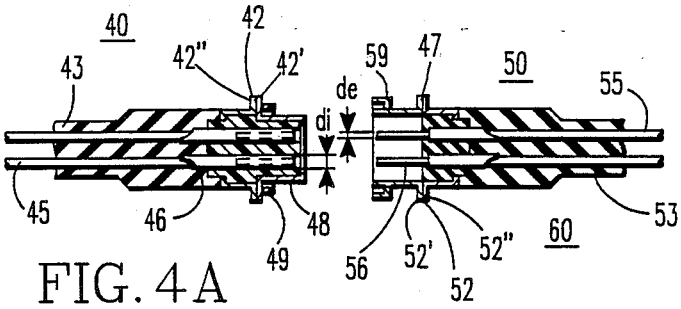
FIG. 4A is a side plan view of both the male and the female portions of the preferred embodiment, an EMI shielded connector prior to interconnection of the male and the female portions; and, FIG. 4B is a side plan view of both the male and the female portions of the preferred embodiment EMI shielded connector after the male and the female portions are interconnected.

FIG. 3A is a top plan view of the mating surface of the female portion 40 of the preferred embodiment an EMI shielded connector 60, as shown in greater detail in FIG. 4A. The female portion 40, comprises a connector back plate 42. This connector back plate 42, has a front surface 42', wherein the female portion 40 has mounted upon this front surface 42', two receptacle means 44 which are hollow tube means operable to receive a fastening means. A trapezoidal socket means 48 is mounted upon the connector back plate 42, front surface 42', equidistant between the two receptacle means 44. This trapezoidal socket means 48, while trapezoidal in geometric configuration, and has a predetermined interior diameter which fully surrounds a multiplicity of individual, tubular, pin holders 46. These individual, tubular, pin holders 46 have a predetermined internal diameter, $d_i$, such that they are operable to receive and hold pins 56, when pins 56 have a slightly smaller external diameter, $d_e$, then the internal diameter, $d_i$, of the pin holders 46. These pins 56, may be more clearly seen in FIG. 3C.

As also shown in FIG. 3A, the conductive EMI connector seal, 49 comprising, for example, a rubber material filled with silver plated copper beads, is also trapezoidal in configuration, partially encapsulating trapezoidal socket means 48. The EMI connector seal 49 can be vulcanized onto the socket means 48 during fabrication or retrofitted onto the socket 48 after production. The connector seal 49 can be made of conductive elastomers. One such material, CHO-SEAL, a trademark-protected product of Chomerics, Inc. of Woodburn, Mass., is highly conductive and operable to be used in this embodiment.

Figure 3B:
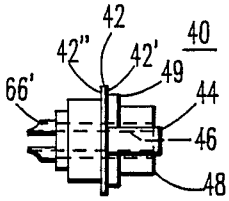
FIG. 3B is a side view of the female portion of the preferred embodiment an EMI shielded multi-shell connector.

FIG. 3B is a side view of the female portion 40 of the preferred embodiment, an EMI shielded connector 60, as shown in greater detail in FIG. 4A. The female portion 40, comprises connect pins 66' mounted upon a back surface 42'' of a connector plate 42. Mounted upon the front surface 42' of the back plate 42 is a trapezoidal socket means 48. This trapezoidal socket means 48 fully surrounds connector pin holders 46. An EMI connector seal 49 is formed by, for example, a vulcanization process around trapezoidal socket means 48. Each connector pin 46 has an internal diameter, $d_i$ which is less than the external diameter de of the pins 56, as shown in FIG. 3C. The sockets 46 are mechanically connected to the connect pins 66' , through the back plate 42.

FIG. 3C is a top plan view of the mating face of the male portion 50 of the EMI shielded connector 60, which is shown in greater detail in FIG. 4A. The connector back plate 52, for the male portion 50 of the shielded connector 60, has a top surface 52', and has cut within that top surface 52' two holes 47. Two threaded fastening means 54, more clearly shown in FIG. 3D, which are operable to fixedly interconnect within the receptacle means 44 of the female portion 40 as shown in FIGS. 3A and 3B are inserted within these holes 47. A socket means 58, trapezoidal in configuration and forming a slightly larger trapezoidal cavity than the trapezoidal socket means 48 cavity of the female portion 40 of the EMI shielded connector 60 as described in FIG. 4A, is mounted upon top surface 52' of back plate 52. Because the cavity formed by this trapezoidal socket means 58 is slightly larger than the cavity formed by the trapezoidal socket means 48; trapezoidal socket means 58 is therefore operable to slideably interfit over trapezoidal socket means 48 of the female portion 40 of the EMI shielded connector 60 during connector 60 operation.

Also, as shown in FIG. 3C, trapezoidal socket means 58, surrounds a multiplicity of individual pins 56 which are also mounted upon the top surface 52' of connector back plate 52 for male portion 50. These pins 56, have an external diameter $d_e$, such that they are operable to slideably interfit over the pin holders 46 mounted upon the top surface 42', of the connector back plate 42 of the female portion 40 as shown in FIG. 4A, wherein these pin holders 46 have an internal diameter $d_i$, which is slightly greater than the external diameter, $d_e$, of the pins 56. The environmental seal 59 partially encapsulates the trapezoidal socket means 58, and may be vulcanized into place upon the metal socket during fabrication providing an environmental shield against the outside elements for the pins 56 during connector 60 operation.

Figure 3D:
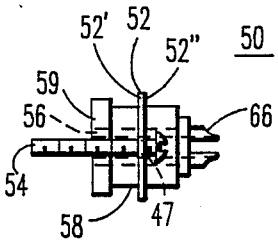
FIG. 3D is a side view of the male portion of the preferred embodiment, an EMI shielded multi-shell connector.

FIG. 3D is a side view of the male portion 50 of the preferred embodiment, an electromagnetic interference shielded multi-shell connector 60. This male portion 50 has a trapezoidal socket means 58 mounted upon a back plate 52 front surface 52'. This socket means 58 forms a trapezoidal cavity which fully surrounds the pins 56. This trapezoidal socket means 58 is partially encapsulated by a seal 59 which serves as an environmental shield, protecting the pins 56 from adverse elements. Connect pins 66, which are operable to receive and transmit an electrical signal, are mechanically interconnected to pins 56, through the back surface 52'' of back plate 52. Holes 47 through back plate 52 are operable to hold a fastening means during connector 60 operation.

FIG. 4A is a side plan view of both the male 50 and the female 40 portions of the preferred embodiment an EMI shielded connector 60, wherein the male 50 and the female 40 portions are not yet fixedly mechanically interconnected.

As shown in FIG. 4A, the female portion 40 in side view, comprises a rectangular back plate 42, having mounted upon its surface; a multiplicity of pin holders 46, each of these pin holders 46 having a predetermined interior diameter $d_i$, and a socket means 48 having a trapezoidal configuration, fully enclosing pin holders 46 and forming a trapezoidal cavity. A shielded cable 45, encapsulated in this embodiment by a molded EMI back shell 43, is fixedly and electrically interconnected to the bottom surface 42'' of the connector back plate 42. This shielded cable 45 mechanically fixedly interconnects with the multiplicity of pin holders 46 mounted upon the top surface 42' of the female portion 40 of the EMI shielded connector 60. The EMI seal 49 which may, for example, be applied to socket means 48 during connector fabrication rests upon the top surface 42' of the back plate 42 of female portion 40. EMI seal 49 may, for example, comprise a highly conductive material such as rubber filled with silver coated copper beads. While the connector 60 in FIG. 4A shows two seals 49, 59 on both the female 40 and the male 50 portions, respectively, only one seal is required to effectively minimize EMI.

Also shown in FIG. 4A, the male portion 50 comprises a rectangular back plate 52, having mounted upon its top surface 52'; a multiplicity of pins 56, each of these pins 56 having a predetermined exterior diameter, $d_e$, and a socket means 58 having a trapezoidal geometric configuration, forming a trapezoidal cavity wherein this socket means 58 formed cavity fully surrounds pins 56. This trapezoidal socket means 58, resting upon the front surface 52', of male portion 50 of the EMI shielded connector 60 is further operable to slideably interfit over the trapezoidal socket means 48 of the female portion 40 for the EMI shielded connector 60.

As shown in FIG. 4A, shielded cable means 55, in this embodiment is encapsulated by a molded EMI back shell 53. However this EMI back shield 53 can be fixedly mechanically interconnected to the back surface 52'', of connector back plate 52. Shielded cable 55 electrically interfaces with and is physically connected to the multiplicity of pins 56 mounted upon the front surface 52' of male portion 50. Also, in FIG. 4A the environmental seal 59 can be seen partially encapsulating the trapezoidal socket means 58 at a point midway between the back plate 52 of male portion 50 and the free end of the socket means 58. This environmental seal 59 is of a thickness which is less than the thickness of the EMI seal 49 which rests upon the top surface 42' of back plate 42 of female portion 40.

Figure 4B:
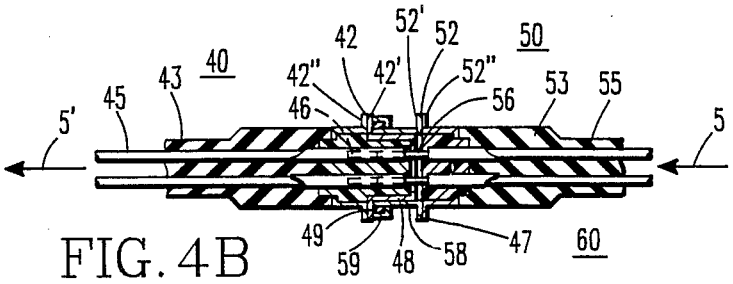

Electrical signal 5, in FIG. 4B passes through the preferred embodiment, mated connector 60. The male portion 50 and the female portion 40 become mechanically and electrically fixedly interconnected. When the male portion 50 and the female portion 40 are mechanically fixedly interconnected in this manner, socket means 48 of female portion 40 slidably interfits into socket means 58 of male portion 50 A second EMI seal or "environmental" seal 59 vulcanized or molded onto the male portion 50 slideably interfits within the first EMI seal 49 of the female portion 40. Also, the multiplicity of pins 56 upon the top surface 52' of the connector plate 52, because of their smaller external diameter, $d_e$, slideably interfit the multiplicity of pin holders 46 mounted upon the top surface 42' of the connector plate 42. These pins 56 having a predetermined exterior diameter, $d_e$, wherein this exterior diameter, $d_e$, is less than the interior diameter $d_i$, of the pin sockets 46 facilitate electrical contact between shielded cable 45 of female portion 40 and shielded cable 55 of male portion 50. An electrical signal 5, entering the mated EMI shielded connector 60 enters via shielded cable 55. This shielded cable 55 which is mechanically attached to connector plate 52 is operable to transmit electrical signal 5 to the multiplicity of pins 56 which fixedly mechanically interfits the pin sockets 46 of the female portion 40. Signal 5' is shown exiting female portion 40 through back shell 43, and shielded cable 45 of female portion 40.

FIG. 4B is a side plan view of both the male portion 50 and the female portion 40 of the fully EMI shielded connector 60, the preferred embodiment of our invention. In this plan side view of connector 60 no air gap exits between trapezoidal socket means 48 of female portion 40 and trapezoidal socket means 58 of male portion 50. This highly conductive, rubber based trapezoidal EMI seal 49 slideably interfits over the trapezoidal environmental seal 59. EMI leakage which usually occurs between and within multi-shell connectors not featuring such EMI and environmental seals 49 and 59 will be minimized by this seal interlock concept. Signal 5' is shown exiting female portion 40 through back shell 43 and shielded cable 45 of female portion 40. Electrical signal 5 entering via male portion 50 through shielded cable 55 passes through pins 56 into the electrical connection of pin sockets 46, female portion 40 with a minimized EMI loss into the surrounding circuit. Also, this dual shielding approach protects the signal 5 from ambient EMI leakage.

Numerous variations may be made in the abovedescribed combination and different embodiments of this invention may be made without departing from the spirit thereof. Therefore, it is intended that all matter contained in the foregoing description and in the accompanying drawings shall be interpreted as illustrative and not in a limiting sense.

We claim:

1. An improved, multi-shell, electrical connector apparatus having a male shell portion, said male shell portion having at least one pin means, said electrical connector apparatus also having a female shell portion, said female shell portion having at least one pin holder, said male and said female shell portions operable to slideably interfit one another, thereby electrically interconnecting said pin and said pin holder, said interconnected male and said female shell portions having an air gap between said male and said female shell portions, the improvement comprises:

an electromagnetic interference seal means, said electromagnetic interference seal means comprising a flexible, generally annular, conductive member, said electromagnetic interference seal means slideably interfitting and being fixedly connected to said male shell portion or said female shell portion during said electrical connector apparatus operation, said electromagnetic interference seal means diminishing said air gap between said male shell portion and said female shell portion thereby completing an electrical connection between said male shell portion and said female shell portion of said electrical connector apparatus and whereby said diminished air gap and said electrical connection reduces the electromagnetic interference emitted from said electrical connector apparatus and said electromagnetic interference entering said electrical connector apparatus.

2. An improved, multi-shell electrical connector apparatus, as in claim 1 wherein said electromagnetic interference seal further comprises a highly conductive material such as rubber impregnated with silver coated copper beads.

3. An improved, multi-shell electrical connector apparatus, as in claim 1 wherein said electromagnetic interference seal is applied to both said male and said female shell portion.

4. An improved electrical cable connector means, having a first electrical cable means, said first electrical cable means being fully electromagnetic interference shielded and operable to transmit an electrical signal, said improved electrical cable connector means having a first connector shell means, said first connector shell means being mechanically and electrically fixedly interconnected to said first electrical cable means, and said first connector shell means further comprising at least one pin means operable to receive said electrical signal from said first electrical cable means, said pin means being further operable to transmit said received electrical signal, said improved electrical cable connector means having a second connector shell means, said second connector shell means having at least one pin socket means, said pin socket means being operable to encapsulate and retain said pin means, said pin socket means being further operable to receive said electrical signal from said pin means of said first connector shell means when said first connector shell means and said second connector shell means are mechanically fixedly interconnected during said electrical cable connector means operation, said improved electrical cable connector means having a cable connector shell fastening means, said cable connector shell fastening means being operable to mechanically fixedly interconnect said first connector shell means and said second connector shell means during said electrical cable connector means operation, said improved electrical cable connector means having, a second electrical cable means, said second electrical cable means being fully electromagnetically interference shielded and mechanically and electrically fixedly interconnected to said pin socket means of said second connector shell means such that said electrical signal received from said pin means by said pin socket means is received and transmitted by said second electrical cable means, wherein the improvement comprises:

an electromagnetic interference seal means, said electromagnetic interference seal means partially encapsulating said second connector shell means such that when said first connector shell means and said second connector shell means are mechanically and electrically fixedly interconnected zero clearance occurs between said first connector shell means and said second connector shell means and no leakage of said electrical signal occurs between said first connector shell means and said second connector shell means.

5. An improved electrical cable connector means as in claim 4, wherein said electromagnetic interference seal means is a highly conductive material.

6. An improved electrical cable connector means as in claim 4, wherein said electromagnetic interference seal means comprises a rubber material impregnate with silver coated copper beads.

7. An improved electrical cable connector means as in claim 4, wherein an environmental seal means partially encapsulates said first connector shell means such that when said first connector shell means and said second connector shell means are mechanically and electrically fixedly interconnected, said environmental seal means slideably interfits said electromagnetic interference seal means thereby protecting said pins of said first connector shell means from the elements.

8. An improved electrical cable connector means, having a first electrical cable means, said first electrical cable means being fully electromagnetic interference shielded and operable to transmit an electrical signal, said improved electrical cable connector means having a first connector shell means, said first connector shell means being mechanically and electrically fixedly interconnected to said first electrical cable means, and said first connector shell means further comprising at least one pin means operable to receive said electrical signal from said first electrical cable means, said pin means being further operable to transmit said received electrical signal, said improved electrical cable connector means having a second connector shell means, said second connector shell means having at least one pin socket means, said pin socket means being operable to encapsulate and retain said pin means, said pin socket means being further operable to receive said electrical signal from said pin means of said first connector shell means when said first connector shell means and said second connector shell means are mechanically fixedly interconnected during said electrical cable connector means operation, said improved electrical cable connector means having a cable connector shell fastening means, said cable connector shell fastening means being operable to mechanically fixedly interconnect said first connector shell means and said second connector shell means during said electrical cable connector means operation, said improved electrical cable connector means having, a second electrical cable means, said second electrical cable means being fully electromagnetically interference shielded and mechanically and electrically fixedly interconnected to said pin socket means of said second connector shell means such that said electrical signal received form said pin means by said pin socket means is received and transmitted by said second electrical cable means, wherein the improvement comprises:

an electromagnetic interference seal means, said electromagnetic interference seal means partially encapsulates said second connector shell means such that when said first connector shell means and said second connector shell means are mechanically and electrically fixedly interconnected, no air gap exits between said first connector shell means and said second connector shell means and no leakage of said electrical signal occurs between said first connector shell means and said second connector shell means; and an environmental seal means partially encapsulates said first connector shell means such that when said first connector shell means and said second connector shell means are mechanically and electrically fixedly interconnected, said environmental seal means slidably interfits said electromagnetic interference seal means thereby protecting said pins of said first connector shell means from the elements.

9. An improved electrical cable connector means, having a first electrical cable means, said first electrical cable means being fully electromagnetic interference shielded and operable to transmit an electrical signal, said improved electrical cable connector means having a first connector shell means, said first connector shell means being mechanically and electrically fixedly interconnected to said first electrical cable means, and said first connector shell means further comprising at least one pin means operable to receive said electrical signal from said first electrical cable means, said pin means being further operable to transmit said received electrical signal, said improved electrical cable connector means having a second connector shell means, said second connector shell means having at least one pin socket means, said pin socket means being operable to encapsulate and retain said pin, means, said pin socket means being further operable to receive said electrical signal from said pin means of said first connector shell means when said first connector shell means and said second connector shell means are mechanically fixedly interconnected during said electrical cable connector means operation, said improved electrical cable connector means having a cable connector shell fastening means, said cable connector shell fastening means being operable to mechanically fixedly interconnect said first connector shell means and said second connector shell means during said electrical cable connector means operation, said improved electrical cable connector means having, a second electrical cable means, said second electrical cable means being fully electromagnetically interference shielded and mechanically and electrically fixedly interconnected to said pin socket means of said second connector shell means such that said electrical signal received from said pin means by said pin socket means is received and transmitted by said second electrical cable means, wherein the improvement comprises:

an electromagnetic interference seal means, said electromagnetic interference seal means partially encapsulates said first connector shell means such that when said first connector shell means and said second connector shell means are mechanically and electrically fixedly interconnected, zero clearance occurs between said first connector shell means and said second connector shell means and no leakage of said electrical signal occurs between said first connector shell means and said second connector shell means; and an environmental seal means partially encapsulates said first connector shell means such that when said first connector shell means and said second connector shell means are mechanically and electrically fixedly interconnected, said environmental seal means slidably interfits said electromagnetic interference seal means thereby protecting said pins of said first connector shell means from the elements.

* * * * *